US007972046B2

(12) United States Patent
Iwasaki

(10) Patent No.: US 7,972,046 B2
(45) Date of Patent: Jul. 5, 2011

(54) VEHICLE LIGHTING DEVICE

(75) Inventor: Kazunori Iwasaki, Tokyo (JP)

(73) Assignee: Ichikoh Industries, Ltd., Tokyo (JP)

( * ) Notice: Subject to any disclaimer, the term of this patent is extended or adjusted under 35 U.S.C. 154(b) by 206 days.

(21) Appl. No.: 12/403,764

(22) Filed: Mar. 13, 2009

(65) Prior Publication Data

US 2009/0284979 A1 Nov. 19, 2009

(30) Foreign Application Priority Data

May 14, 2008 (JP) ..... 2008-127097

(51) Int. Cl.
*F21V 7/09* (2006.01)

(52) U.S. Cl. ..... 362/517; 362/518

(58) Field of Classification Search ..... 362/517, 362/518, 538, 539
See application file for complete search history.

(56) References Cited

U.S. PATENT DOCUMENTS

| | | | | |
|---|---|---|---|---|
| 6,575,608 | B2 | 6/2003 | Oyama et al. | |
| 6,882,110 | B2 | 4/2005 | Ishida et al. | |
| 7,207,705 | B2 | 4/2007 | Ishida | |
| 2004/0022067 | A1* | 2/2004 | Taniuchi | 362/517 |
| 2004/0228139 | A1* | 11/2004 | Taniuchi | 362/539 |

FOREIGN PATENT DOCUMENTS

| | | | |
|---|---|---|---|
| EP | 1 528 313 | A2 | 5/2005 |
| EP | 1 705 422 | A1 | 9/2006 |
| JP | 2006-019052 | A | 1/2006 |
| JP | 2008-41557 | A | 2/2008 |

OTHER PUBLICATIONS

U.S. Appl. No. 12/403,778, filed Mar. 13, 2009, Iwasaki.
K. Iwasaki, U.S. PTO Notice of Allowance, U.S. Appl. No. 12/403,778, dated Feb. 23, 2011, 11 pages.

* cited by examiner

*Primary Examiner* — David V Bruce
(74) *Attorney, Agent, or Firm* — Foley & Lardner LLP

(57) ABSTRACT

A lighting device of the present invention includes: a first reflecting surface which is an elliptical reflecting surface; a semiconductor-type light source which is disposed at a first focal point of the first reflecting surface; and parabolic reflecting surfaces for controlling reflected light from the first reflecting surface and reflecting the controlled reflected light on a road surface, as predetermined light distribution patterns. The parabolic reflecting surfaces are a plurality of reflecting surfaces which are longitudinally divided into three sections. As a result, longitudinal steps are formed among the three parabolic reflecting surfaces that are longitudinally divided. Thus, if the reflected light from the first reflecting surface is incident to the longitudinal steps, the incident light is reflected in the lateral direction, i.e., in the transverse direction at the steps. In this manner, vertical stray light can be prevented.

5 Claims, 13 Drawing Sheets

VEHICLE LIGHTING DEVICE

CROSS-REFERENCE TO RELATED APPLICATIONS

The present application claims priority to and incorporates by reference the entire contents of Japanese priority document 2008-127097 filed in Japan on May 14, 2008.

BACKGROUND OF THE INVENTION

1. Field of the Invention

The present invention relates to a vehicle lighting device employing a semiconductor-type light source as a light source and having a plurality of reflecting surfaces.

2. Description of the Related Art

A vehicle lighting device of this type is conventionally disclosed in Japanese Laid-open Patent Application No. 2008-41557, for example. Hereinafter, the conventional vehicle lighting device will be explained. The conventional vehicle lighting device is provided with a semiconductor-type light source, a first reflecting surface, a second reflecting surface, a third reflecting surface, and a fourth reflecting surface. Hereinafter, effects of the conventional vehicle lighting device will be explained. First, the semiconductor-type light source is intended to illuminate and emit light. Part of light radiated from the semiconductor-type light source is then reflected by the first reflecting surface. Part of the reflected light is reflected by the third reflecting surface, and is radiated on a road surface, as a light distribution pattern having a horizontal cut-line on an upper edge. In addition, the remainder of the reflected light from the first reflecting surface is mainly reflected by the second reflecting surface, and is radiated on a road surface, as a light distribution pattern having a hot spot portion superimposed in the light distribution pattern and a protrusive portion including an oblique cut-line projecting upwardly of the horizontal cut-line. Further, the remainder of the light radiated from the semiconductor-type light source is mainly reflected by the fourth reflecting surface, and is radiated on an overhead sign or the like, as an overhead sign light distribution pattern. Therefore, in the conventional vehicle lighting device, an ideal light distribution pattern can be obtained by one lamp unit.

A problem to be solved by the invention is to improve the conventional vehicle lighting device described previously.

SUMMARY OF THE INVENTION

The invention according to a first aspect is characterized by a vehicle lighting device employing a semiconductor-type light source as a light source and having a plurality of reflecting surfaces, the device including: a first reflecting surface which is an elliptical reflecting surface; the semiconductor-type light source being disposed at or near a first focal point of the first reflecting surface; and parabolic reflecting surfaces for controlling reflected light from the first reflecting surface and reflecting the controlled reflected light as a predetermined light distribution pattern on a road surface, wherein the parabolic reflecting surface is a plurality of longitudinally divided surfaces.

According to the invention of the first aspect, longitudinal steps are formed among a plurality of parabolic reflecting surfaces which are longitudinally divided. Thus, in the vehicle lighting device of the invention, if the reflected light from the first reflecting surface is incident to the longitudinal steps, the incident light is reflected in the lateral direction, i.e., in the transverse direction at the steps. As a result, the vehicle lighting device of the invention can prevent vertical stray light in comparison with the device in which the reflected light from the first reflecting surface is incident to horizontal steps among the plurality of parabolic reflecting surfaces which are laterally divided, and is reflected in the longitudinal direction, i.e., in the vertical direction at the steps. Therefore, in the vehicle lighting device of the invention, an ideal light distribution pattern can be obtained by one lamp unit, making it possible to contribute to traffic safety. In particular, the vehicle lighting device of the invention is effective in a case where a light distribution pattern is a light distribution pattern for passing because the device can prevent vertical stray light.

The invention according to a second aspect is characterized in that: among the plurality of parabolic reflecting surfaces, the parabolic reflecting surface of an opposite lane side (a lane side on which the other car runs oppositely) is positioned at a light reflecting direction relative to the parabolic reflecting surface of a driving lane side (a lane side on which one's own car runs oppositely).

According to the invention of the second aspect, the longitudinal steps among the plurality of parabolic reflecting surfaces which are longitudinally divided are oriented to the driving lane side. Therefore, in the vehicle lighting device of the invention, if the reflected light from the first reflecting surface is incident to the longitudinal steps, the incident light is reflected in the lateral direction at the steps and in the direction of the driving lane side. As a result, the vehicle lighting device of the invention can prevent stray light in the lateral direction and in the direction of the opposite lane side. Therefore, the vehicle lighting device of the invention can further obtain an ideal light distribution pattern by one lamp unit, and can further contribute to traffic safety. In particular, the vehicle lighting device of the invention is effective in a case where a light distribution pattern is a light distribution pattern for passing because the device can prevent stray light in the lateral direction and in the direction of the opposite lane side.

The invention according to a third aspect is characterized in that: the plurality of parabolic reflecting surfaces are made of a second reflecting surface as a middle reflecting surface and third and fourth reflecting surface as left and right reflecting surfaces, the parabolic reflecting surfaces being three longitudinally divided surfaces; the second reflecting surface is a reflecting surface for controlling reflected light from the first reflecting surface and reflecting the controlled reflected light as a light distribution pattern for concentrating light on a road surface; and the third and fourth reflecting surfaces are reflecting surfaces for controlling reflected light from the first reflecting surface and reflecting the controlled reflected light as a light distribution pattern for diffusion on a road surface.

According to the invention of the third aspect, the second reflecting surface is positioned in the middle of the parabolic reflecting surfaces divided into three sections. Thus, this second reflecting surface is suitable for controlling the reflected light from the first reflecting surface as a light distribution pattern for concentrating light. On the other hand, in the vehicle lighting device of the invention, the third and fourth reflecting surfaces are positioned at the left and right of the parabolic reflecting surfaces longitudinally divided into three sections. Thus, the third and fourth reflecting surfaces are suitable for controlling the reflected light from the first reflecting surface as a light distribution pattern for diffusion. Therefore, in the vehicle lighting device of the invention, the light distribution pattern for concentrating light, appropriately controlled on the second reflecting surface, are superimposed on the light distribution pattern for diffusion, appropriately controlled on the third and fourth reflecting surfaces.

Thus, a further ideal light distribution pattern can be obtained by one lamp unit, making it possible to further contribute to traffic safety.

The invention according to a fourth aspect is characterized in that: a shade for cutting off part of the reflected light from the first reflecting surface is provided at or near a second focal point of the first reflecting surface; a shade reflecting surface for reflecting part of the reflected light from the first reflecting surface on the parabolic reflecting surface, cut off by the shade, is provided at the shade; and the plurality of parabolic reflecting surfaces are reflecting surfaces, focal points of which are positioned at or near the second focal point of the first reflecting surface, and further, the reflected light from the first reflecting surface and the reflected light from the shade reflecting surface are controlled and reflected on a road surface, as a light distribution pattern for passing.

According to the invention of the fourth aspect, part of the reflected light from the first reflecting surface is cut off by a shade, so that the light distribution pattern for passing, having a cutoff line, can be easily controlled on the parabolic reflecting surfaces longitudinally divided into a plurality of sections. Moreover, in the vehicle lighting device of the invention, part of the reflected light from the first reflecting surface, which is cut off by the shade, is reflected by the parabolic reflecting surfaces longitudinally divided into a plurality of sections on the shade reflecting surface, thus making it possible to efficiently utilize the light radiated from the semiconductor-type light source. Therefore, in the vehicle lighting device of the invention, an ideal light distribution pattern for passing can be obtained by one lamp unit, making it possible to contribute to traffic safety.

The invention according to a fifth aspect is characterized in that: a parabolic reflecting surface for overhead sign, focal points of which are positioned at or near the semiconductor-type light source and light from the semiconductor-type light source is controlled and reflected as a light distribution pattern for overhead sign, is provided upwardly of the plurality of parabolic reflecting surfaces.

According to the invention of the fifth aspect, the parabolic reflecting surface for overhead sign is positioned upwardly of the parabolic reflecting surfaces longitudinally divided into a plurality of sections. Thus, this parabolic reflecting surface for overhead sign is suitable for controlling the light from the semiconductor-type light source as a light distribution pattern for overhead sign. Therefore, in the vehicle lighting device of the invention, ideal light distribution patterns for passing and overhead sign can be obtained by one lamp unit, making it possible to contribute to traffic safety.

DESCRIPTION OF THE PREFERRED EMBODIMENTS

Figure 1:
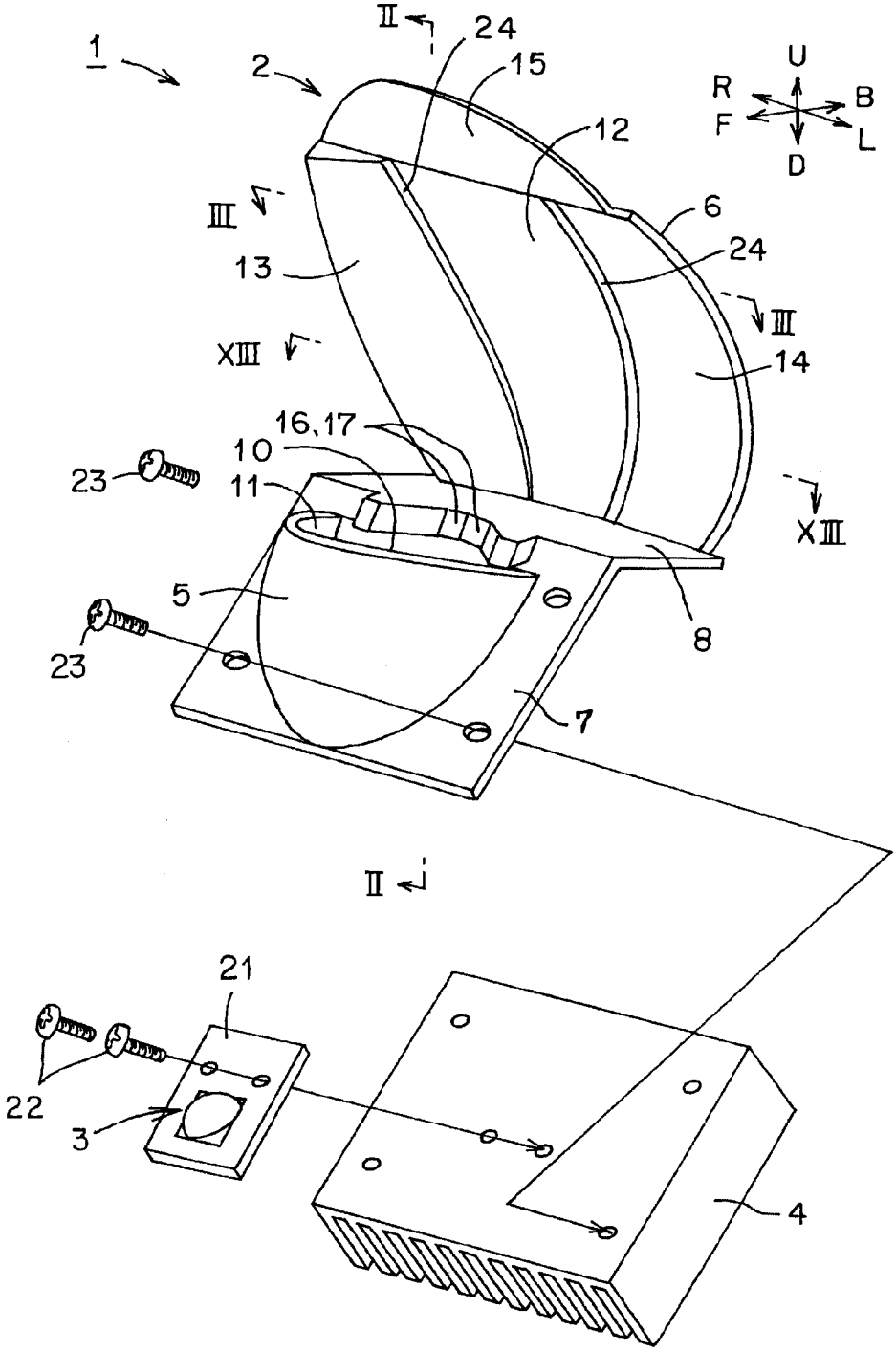
FIG. 1 is an exploded perspective view of a reflector, a semiconductor-type light source, and a heat sink member showing an embodiment of a vehicle lighting device according to the invention.

Hereinafter, an embodiment of a vehicle lighting device according to the present invention will be explained in detail, referring to the drawings. This embodiment does not limit the present invention. In the drawings, a symbol "F" denotes a vehicle front direction (vehicle forward-moving direction). A symbol "B" denotes a vehicle backward direction. A symbol "U" denotes an upward direction in which the front direction is seen from a driver's side. A symbol "D" denotes a downward direction in which the front direction is seen from the driver's side. A symbol "L" denotes a leftward direction in which the front direction is seen from the driver's side. A symbol "R" denotes a rightward direction in which the front direction is seen from the driver's side. A symbol "H-H" denotes a horizontal axis (an axis parallel to a vehicle forward-moving axis). The forward, backward, upward, downward, leftward, rightward, and horizontal directions are equivalent to those in a case where a vehicle is equipped with the vehicle lighting device according to the present invention. Further, a symbol "VU-VD" denotes a vertical line of the top and bottom of a screen. A symbol "HL-HR" denotes a horizontal line of the left and right of the screen.

Hereinafter, an arrangement of a vehicle lighting device in the embodiment will be explained. The vehicle lighting device in the embodiment is a four-light system head lamp for passing (for low beam) of a reflector type (reflection type), for example, which is provided at each of the front left and right of a vehicle (automobile). The headlamp is used for left-hand traffic in Japan. A headlamp used for left-hand traffic in Europe has an arrangement which is substantially similar to that of the aforementioned headlamp. Further, headlamps used for right-hand traffic in Europe and for right-hand traffic in North America have an arrangement which is substantially similar to that of the aforementioned headlamps, and are reversely laid out at the left and right.

The vehicle lighting device in the embodiment is provided with: one lamp unit 1; a lamp housing (not shown); and a lamp lens which is not shown (such as transparent outer lens, for example). The lamp unit 1 is disposed in a light room (not shown) which is partitioned by the lamp housing and the lamp lens. Further, the lamp unit 1 is mounted in the lamp housing via a holder, a bracket (not shown), and an optical axis adjuster (not shown).

Figure 2:
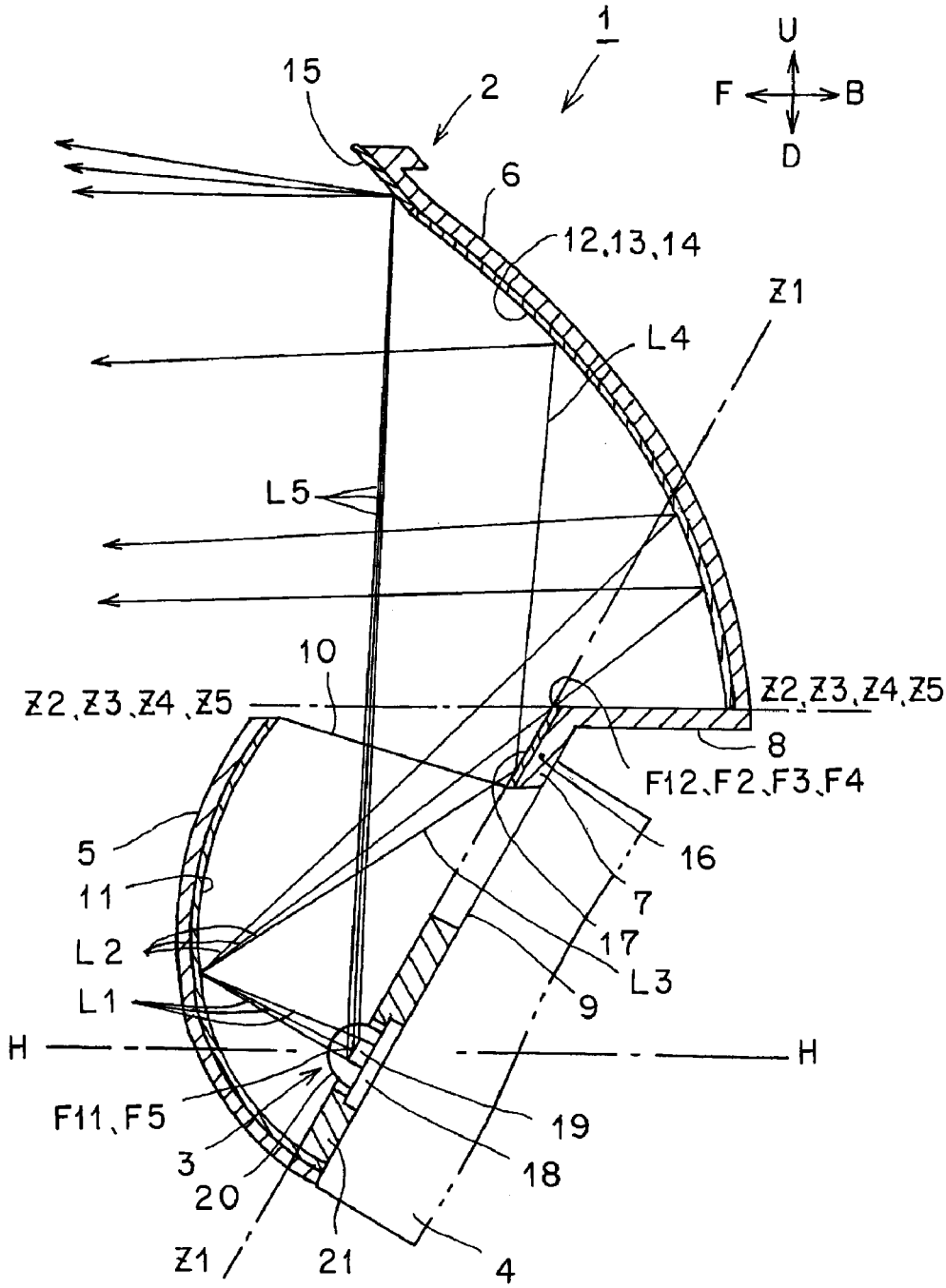
FIG. 2 is a longitudinal cross section (vertical cross section) equivalent to a cross sectional view taken along the line II-II in FIG. 1 showing an optical path.

The lamp unit 1 is made up of a reflector 2, a semiconductor-type light source 3, and a heat sink member 4, as shown in FIG. 1. The reflector 2 is made up of a material such as a light-reflecting resin, for example. The reflector 2 is integrally made up of an elliptical portion 5, a parabolic portion 6, an inclined portion 7, and a horizontal portion 8, as shown in FIGS. 1 and 2.

The elliptical portion 5 is formed so that the elliptical shape of revolution is divided into four sections in the long-axis and short-axis directions. This elliptical portion has a first opening 9 in the long-axis direction and a second opening 10 in the short-axis direction. The inclined portion 7 is integrally provided at an edge of the first opening 9 of the elliptical portion 5. One edge (front end) of the horizontal portion 8 is integrally provided at one end (upper edge) of the inclined portion 7. One edge (lower edge) of the parabolic portion 6 is integrally provided at the other edge (rear edge) of the horizontal portion 8. The elliptical portion 5 is positioned at the frontally obliquely lower side relative to the parabolic portion 6. The parabolic portion 6 is opposite to the second opening 10 of the elliptical portion 5. The inclined portion 7, at one edge (upper edge), is inclined in a direction opposite to a light radiating direction of the lamp unit 1 (to the backside), and, at the other edge (lower edge), is inclined in the light radiating direction of the lamp unit 1 (to the front side), relative to the horizontal portion 8. The horizontal portion 8 is (substantially) parallel to the horizontal axis H-H.

On the reflector 2, optical parts such as a first reflecting surface 11, a second reflecting surface 12, a third reflecting surface 13, a fourth reflecting surface 14, a fifth reflecting surface 15, a shade 16, and a shade reflecting surface 17, are integrally arranged. In other words, aluminum evaporation or silver painting is applied to an interior face opposite to the first and second openings 9 and 10 of the elliptical portion 5, and the first reflecting surface 11 is integrally formed. Aluminum evaporation or silver painting is applied to an interior face opposite to the second opening 10 and the first reflecting surface 11 of the parabolic portion 6, and the second, third, fourth, and fifth reflecting surfaces 12, 13, 14, and 15 are integrally formed. The shade 16 is integrally formed at one edge (upper edge) of the inclined portion 7. Aluminum evaporation or silver painting is applied to a face opposite to the second opening 10, the first reflecting surface 11, the second reflecting surface 12, the third reflecting surface 13, and the fourth reflecting surface 14 of the shade 16, and the shade reflecting surface 17 is integrally formed.

As the semiconductor-type light source 3, for example, a self-luminous semiconductor-type light source such as an LED or an electroluminescence (organic electroluminescence) (an LED in the embodiment) is used. The semiconductor-type light source 3, as shown in FIG. 2, is made of: a substrate 18; a light source chip 19 which is provided on one face of the substrate 18; and a hemispherical (dome-shaped) optically transparent member (lens) 20 covering the light source chip 19. The light source chip 19 is formed in a rectangular shape in this example.

The semiconductor-type light source 3 is fixed to the heat sink member 4 by means of a screw 22 via a holder 21. The inclined portion 7 of the reflector 2 is fixed to the heat sink member 4 by means of a screw 23. As a result, the lamp unit 1 is constituted. At this time, the first opening 9 of the elliptical portion 5 of the reflector 2 is closed by the heat sink member 4. The first reflecting surface 11 of the elliptical portion 5 of the reflector 2 is opposite to the semiconductor-type light source 3. Further, the light source chip 19 formed in a rectangular shape, of the semiconductor-type light source 3, is (substantially) orthogonal to the horizontal axis (vehicle forward-moving axis) H-H. In other words, the semiconductor-type light source 3 has an arrangement which is similar to that of a transverse differential bulb (a bulb of which columnar filament is (substantially) orthogonal to the horizontal axis (vehicle forward-moving axis) H-H). In FIG. 1, two screws 23 for fixing the reflector 2 to the heat sink member 4 are shown, whereas two screws are not shown.

The first reflecting surface 11 is an elliptical reflecting surface. The elliptical reflecting surface is a reflecting surface which is made up of a free curved surface with an ellipsoid being a key (base, reference) surface or is a reflecting surface which is made up of a surface having an ellipsoid of revolution. The reflecting surface made of a free curved surface with an ellipsoid being a key (base, reference) surface is a reflecting surface by which the vertical cross section of FIG. 2 forms an ellipsoid and a horizontal cross section (not shown) is made of a parabola, a deformed parabola or ellipsoid, or a combination thereof. As a result, the first reflecting surface 11 that is an elliptical reflecting surface has an optical axis Z1-Z1, a first focal point F11, and a second focal point (or second focal radiation) F12. As shown in FIG. 2, the optical axis Z1-Z1 of the first reflecting surface 11 is inclined relative to the horizontal axis H-H when viewed from a side face. The first focal point F11 is positioned at the frontally obliquely lower side relative to the second focal point F12. The light source chip 19 of the semiconductor-type light source 3 is positioned at or near the first focal point F11 of the first reflecting surface 11. As a result, a majority L1 of light radiated from the light source chip 19 of the semiconductor-type light source 3 is reflected by the first reflecting surface 11, and converges (gathers) at or near the second focal point F12 of the first reflecting surface 11.

The second, third, fourth, and fifth reflecting surfaces 12, 13, 14, and 15 are parabolic reflecting surfaces. The parabolic reflecting surfaces are reflecting surfaces which are made up of free curved surfaces with a parabola being a key (base, reference) surface or reflecting surfaces which are made of surfaces having a parabola of revolution. The reflecting surfaces made of free curved surfaces with a parabola being a key (base, reference) surface are reflecting surface by which the vertical cross section of FIG. 2 forms a parabola and a horizontal cross section (not shown) is made of an ellipsoid, a deformed ellipsoid or parabola, or a combination thereof. As a result, the second, third, fourth, and fifth reflecting surfaces 12, 13, 14, and 15, all of which are parabolic reflecting surfaces, have optical axes Z2-Z2, Z3-Z3, Z4-Z4, Z5-Z5, and focal points (focal radiations) F2, F3, F4, F5. As shown in FIG. 2, the optical axes Z2-Z2, Z3-Z3, Z4-Z4, Z5-Z5 of the second, third, fourth, and fifth reflecting surfaces 12, 13, 14, and 15 are (substantially) parallel to the horizontal axis H-H when viewed from the side face. The focal points F2, F3, F4 of the second, third, and fourth reflecting surfaces 12, 13, and 14 are positioned at or near the second focal point F12 of the first reflecting surface 11. A focal point F5 of the fifth reflecting surface 15 is positioned at or near the first focal point F11 of the first reflecting surface 11.

The first reflecting surface 11 is positioned at the frontally obliquely lower side relative to the second, third, fourth, and fifth reflecting surfaces 12, 13, 14, and 15. An opening for passing reflected light from the first reflecting surface 11 and direct light from the semiconductor-type light source 3 to the second, third, fourth, and fifth reflecting surfaces 12, 13, 14, and 15, i.e., the second opening 10 is provided between a side on which the first reflecting surface 11 and the semiconductor light source 3 are present and a side on which the second, third, fourth, and fifth reflecting surfaces 12, 13, 14, and 15 are present.

The shade 16 cuts off part L3 of reflected light L2 from the first reflecting surface 11. An edge of the shade 16, i.e., a corner between the inclined portion 7 and the horizontal portion 8 is involved in forming a cutoff line of a light distribution pattern. On the other hand, the shade reflecting surface 17 reflects the part L3 of the reflected light L2 from the first reflecting surface 11, the part being cut off by the shade 16, on the second, third, and fourth reflecting surfaces 12, 13, and 14.

Figure 3:
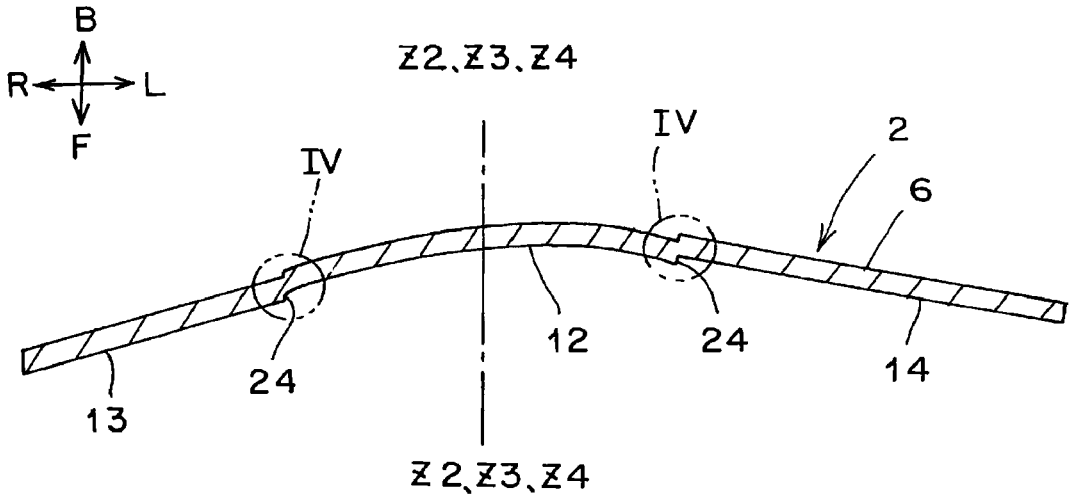
FIG. 3 is a sectional view taken along the line III-III in FIG. 1.
Figure 4:
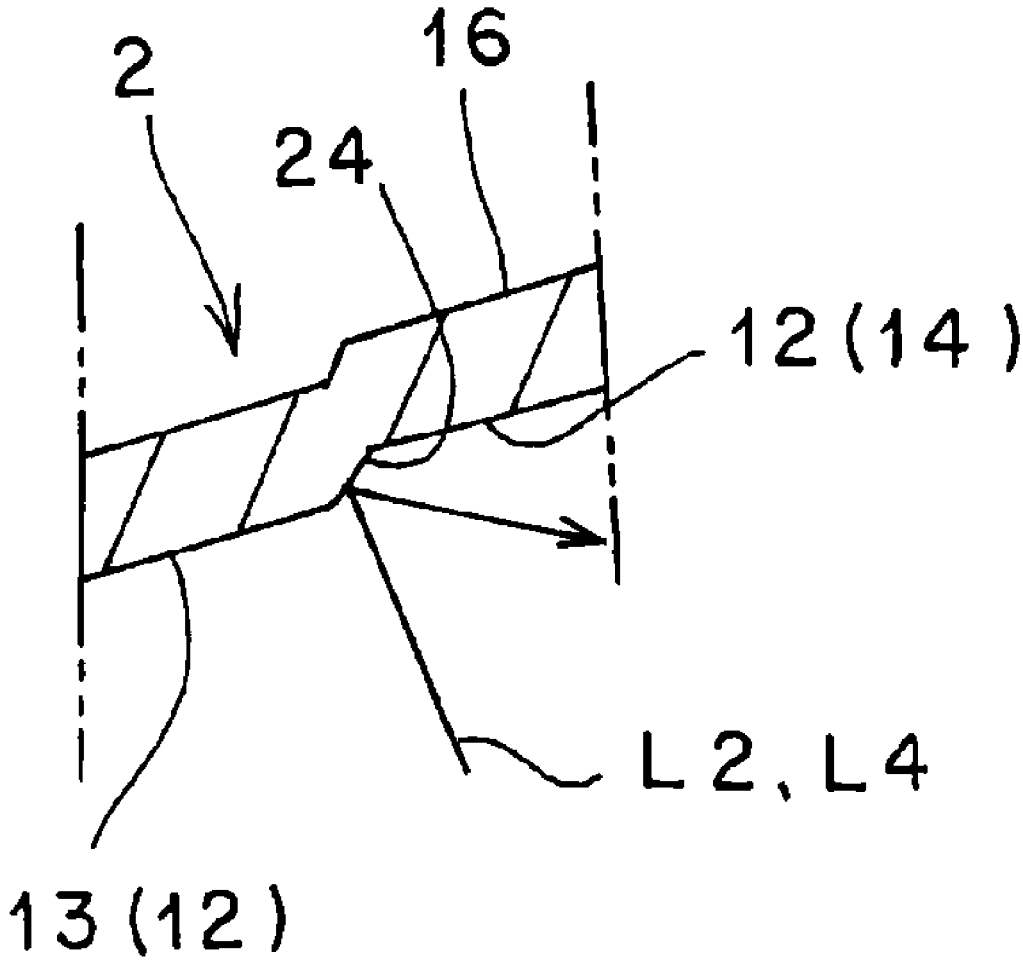
FIG. 4 is an enlarged cross section of an IV portion shown in FIG. 3.

The second, third, and fourth reflecting surfaces 12, 13, and 14 as parabolic reflecting surfaces are longitudinally divided as shown in FIG. 1. The second reflecting surface 12 is positioned between the third and fourth ones. The third reflecting surface 13 is positioned at the right side of the second reflecting surface 12. The fourth reflecting surface 14 is positioned at the left side of the second reflecting surface 12. As shown in FIGS. 3 and 4, the third reflecting surface 13 at the opposite lane side (right side) is positioned at the light reflecting direction (front side) relative to the second reflecting surface 12 of the driving lane side (left side). The second reflecting surface 12 of the opposite lane side (right side) is positioned at the light reflecting direction (front side) relative to the fourth reflecting surface 14 of the driving lane side (left side). As a result, longitudinal steps 24 among the longitudinally divided second, third, and fourth reflecting surfaces 12, 13, and 14 are oriented to the driving lane side (left side).

Figure 5:
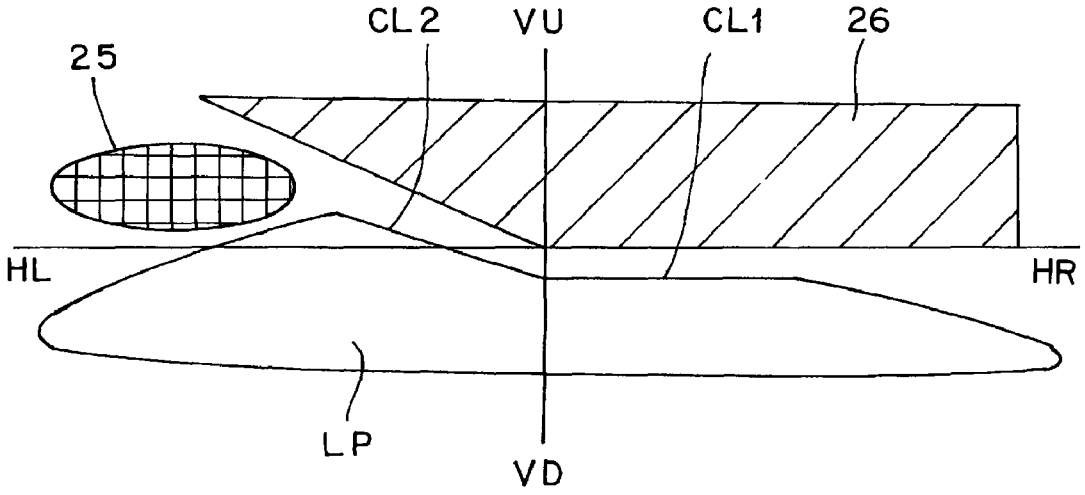
FIG. 5 is a schematic diagram for explaining a light distribution pattern for passing obtained by second, third, and fourth reflecting surfaces.
Figure 6:
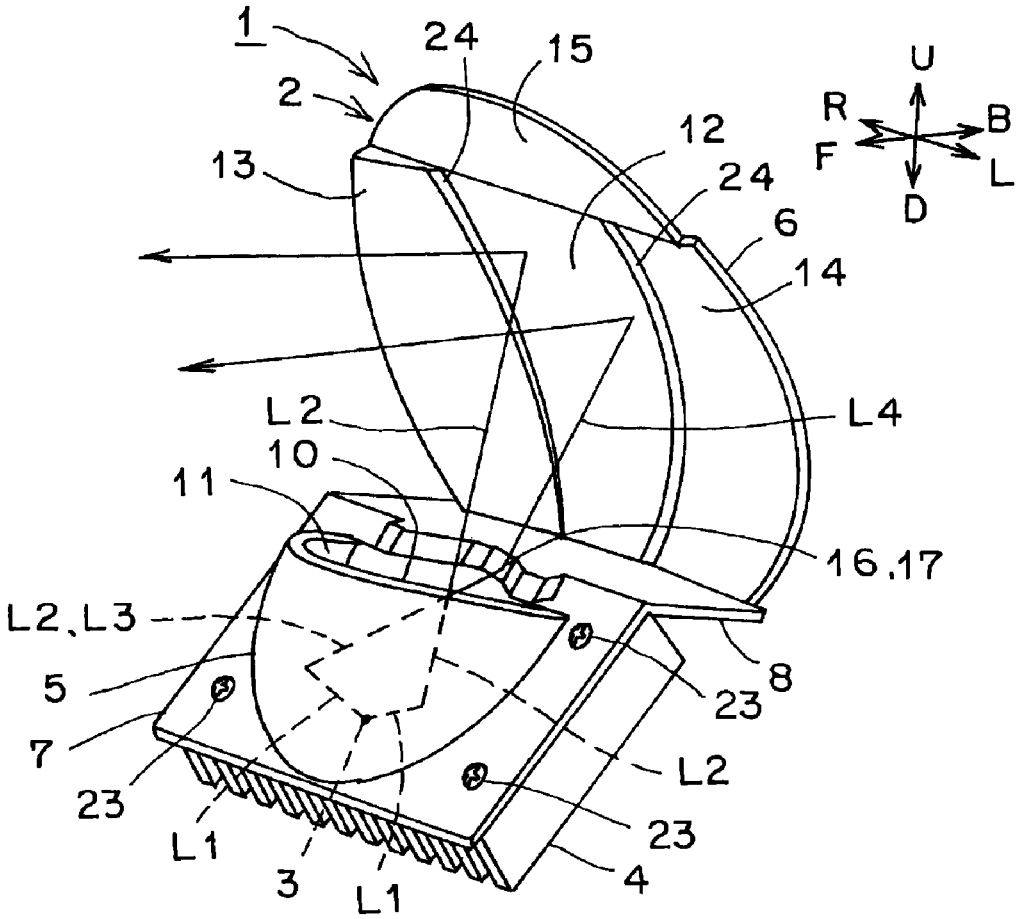
FIG. 6 is a schematic diagram for explaining a reflection effect of the second reflecting surface.
Figure 12:
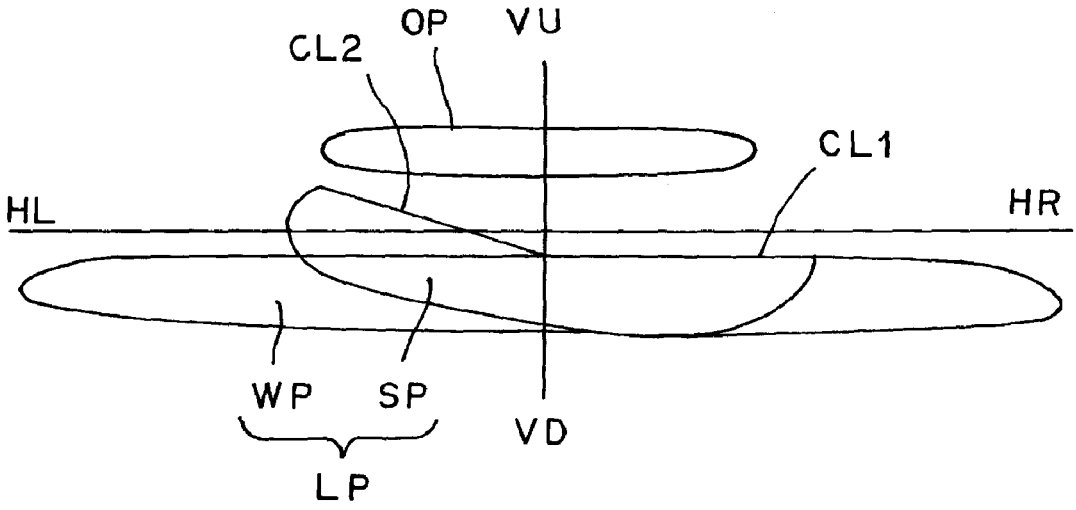
FIG. 12 is a schematic diagram for explaining: a light distribution pattern for light concentration, of the light distribution pattern for passing obtained by the second reflecting surface; a light distribution pattern for diffusion, of the light distribution pattern obtained by the third and fourth reflecting surfaces; and a light distribution pattern for overhead sign obtained by the fifth reflecting surface.
Figure 13:
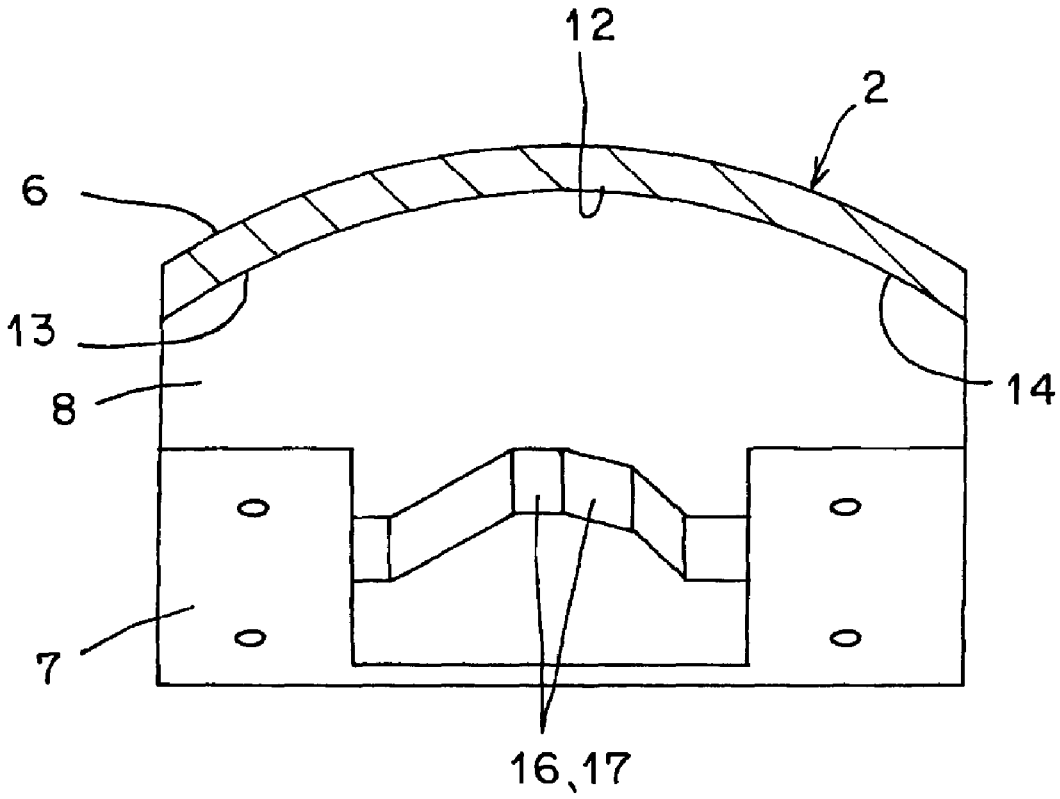
FIG. 13 is a sectional view taken along the line XIII-XIII shown in FIG. 1.

The second, third, and fourth reflecting surfaces 12, 13, and 14 are reflecting surfaces by which reflected light L2 from the first reflecting surface 11 (reflected light L2 from the first reflecting surface 11 that has not been cut off by the shade 16) and reflected light L4 from the shade reflecting surface 17 (part L3 of reflected light L2 from the first reflecting surface 11 cut off by the shade 16) are controlled and reflected on a road surface, as a light distribution pattern LP for passing shown in FIGS. 5 and 12. A horizontal cutoff line CL1 and an oblique cutoff line CL2 are formed at the upper edge of the light distribution pattern LP for passing. The horizontal cutoff line CL1 and the oblique cutoff line CL2, of the light distribution pattern LP for passing, are formed by an edge of the shade 16 and the second, third, and fourth reflecting surfaces 12, 13, and 14. The horizontal cutoff line CL1 of the light distribution pattern LP for passing is positioned by about 0.57 degree lower than the horizontal left-right line HL-HR of a screen. Further, the oblique cutoff line CL2 of the light distribution pattern LP for passing is inclined by about 15 to 45 degrees leftward from the vertical up-down line VU-VD of the screen of the horizontal cutoff line CL1.

Figure 7:
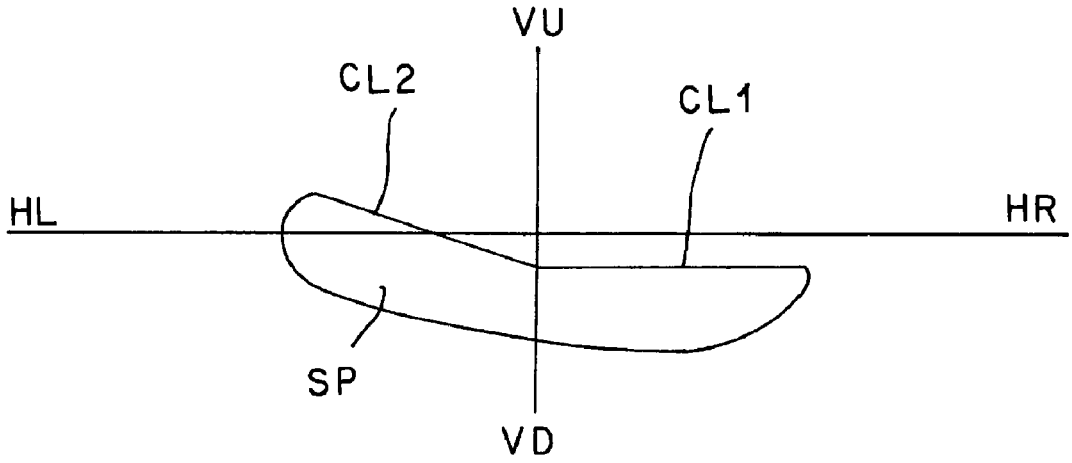
FIG. 7 is a schematic diagram for explaining a light distribution pattern for concentrating light, of the light distribution pattern for passing obtained by the second reflecting surface.
Figure 8:
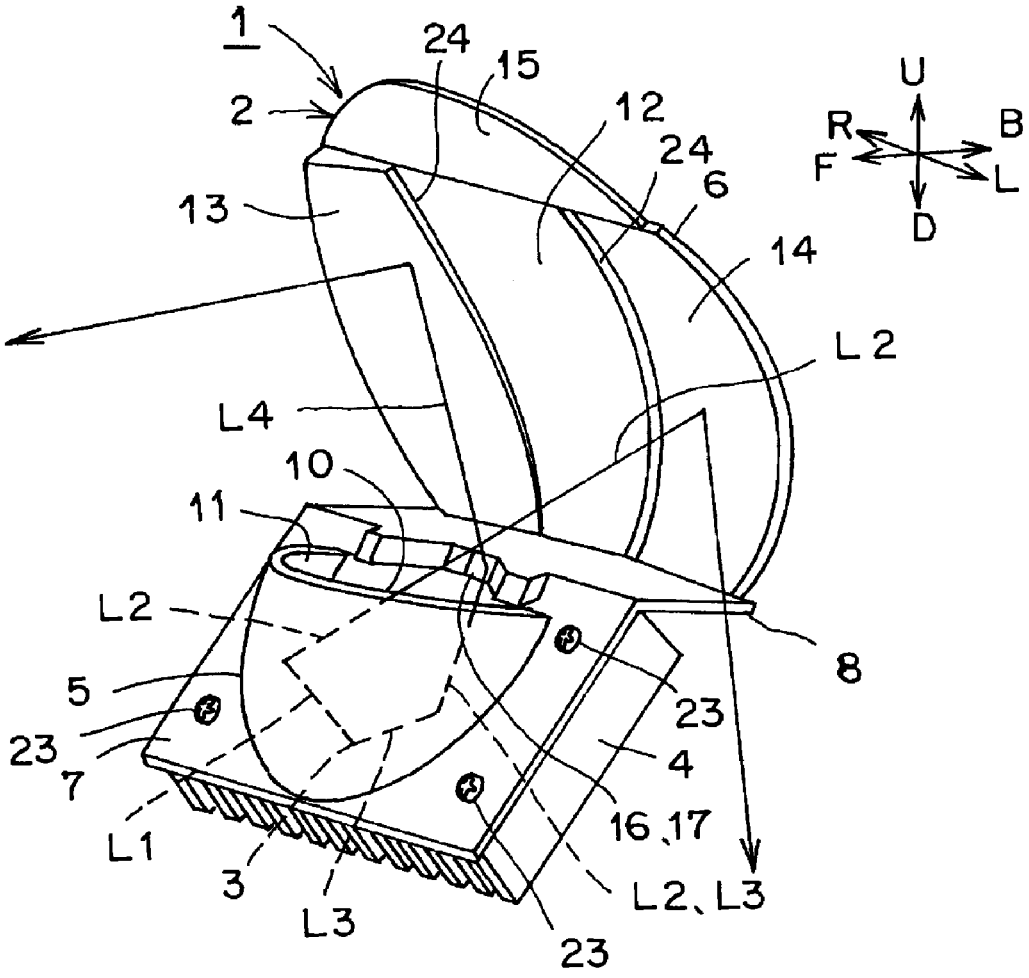
FIG. 8 is a schematic diagram for explaining a reflection effect of the third and fourth reflecting surfaces.

The second reflecting surface 12 is a reflecting surface by which the reflected light L2 from the first reflecting surface 11 and the reflected light L4 from the shade reflecting surface 17 are controlled and reflected on a road surface, as a light distribution pattern SP for concentrating light shown in FIG. 7. The horizontal cutoff line CL1 and the oblique cutoff line CL2 are formed at the upper edge of the light distribution pattern SP for concentrating light. The horizontal cutoff line CL1 and the oblique cutoff line CL2, of the light distribution pattern SP for concentrating light, are formed by an edge of the shade 16 and the second reflecting surface 12. The light distribution pattern SP for concentrating light is a hot spot of the light distribution pattern LP for passing, and satisfies main light distribution standards for the light distribution pattern LP for passing. A high luminous intensity part (hot spot) having the highest luminous intensity exists in the light distribution pattern SP for concentrating light.

Figure 9:
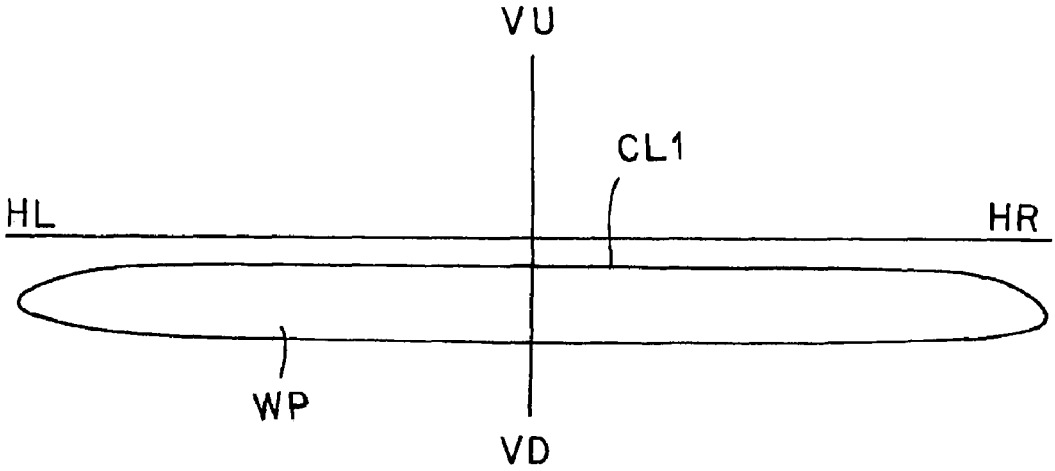
FIG. 9 is a schematic diagram for explaining a light distribution pattern for diffusion, of the light distribution pattern for passing obtained by the third and fourth reflecting surfaces.
Figure 10:
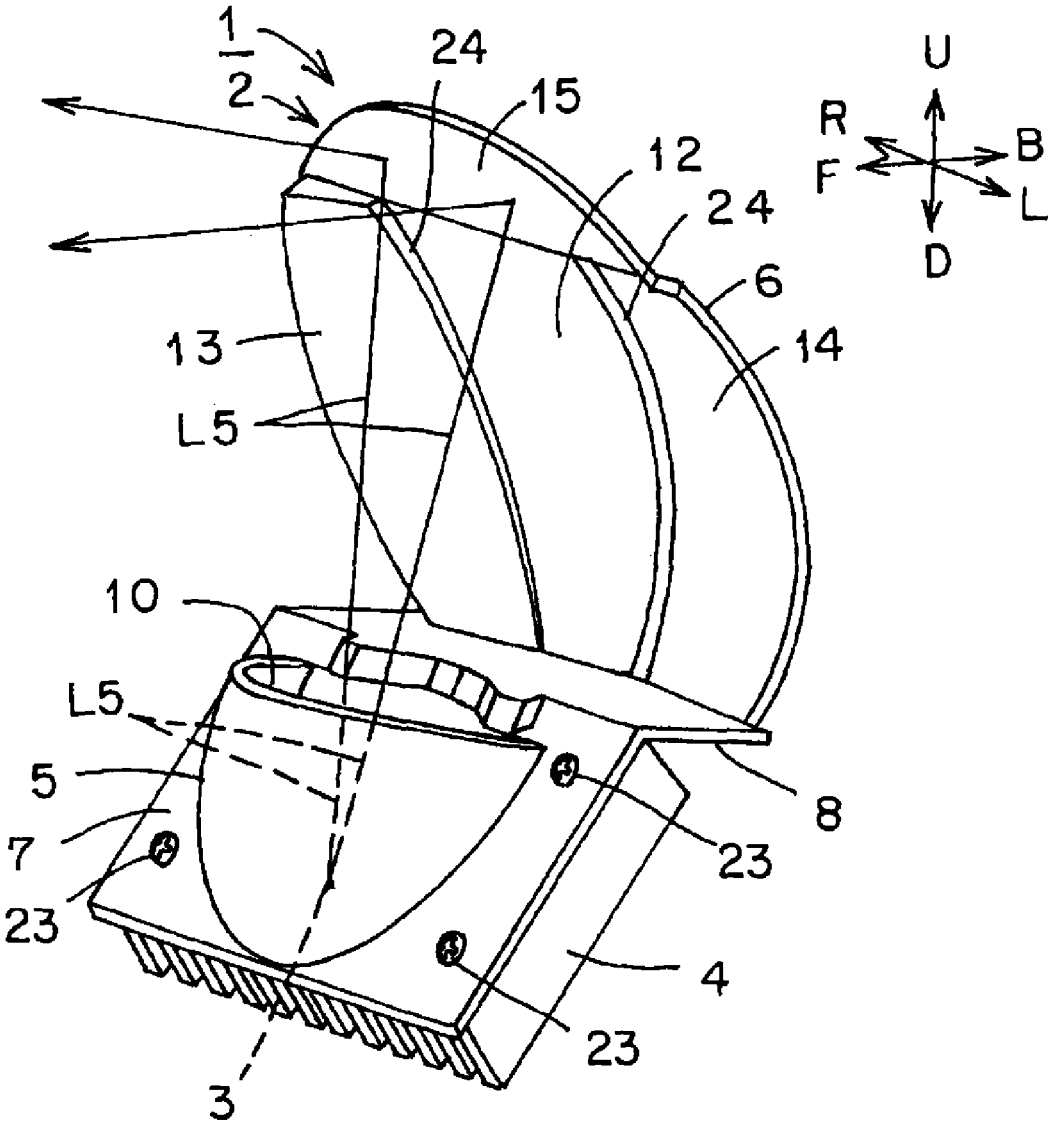
FIG. 10 is a schematic diagram for explaining a reflection effect of a fifth reflecting surface.

The third and fourth reflecting surfaces 13 and 14 are reflecting surfaces by which the reflected light L2 from the first reflecting surface 11 and the reflected light L4 from the shade reflecting surface 17 are controlled and reflected on a road surface, as a light distribution pattern WP for diffusion, shown in FIG. 9. The horizontal cutoff line CL1 is formed on the upper edge of the light distribution pattern WP for diffusion. The horizontal cutoff line CL1 of the light distribution pattern WP for diffusion is formed by an edge of the shade 16 and the third and fourth reflecting surfaces 13 and 14. The light distribution pattern WP for diffusion is horizontal diffusion of the light distribution pattern LP for passing, and forms diffused light distribution which improves marketability of the light distribution pattern LP for passing. The horizontal cutoff line CL1 of the light distribution pattern WP for diffusion may be set by about 0.3 to 1 degree lower than the horizontal cutoff line CL1 of the light distribution pattern SP for concentrating light.

The fifth reflecting surface 15, as shown in FIG. 1, is positioned upwardly of the second, third, and fourth reflecting surfaces 12, 13, and 14, all of which are those longitudinally divided. The fifth reflecting surface 15 is a reflecting surface by which light (direct light) L5 from the semiconductor-type light source 3 is controlled and reflected as a light distribution pattern OP for overhead sign. The light distribution pattern OP for overhead sign is positioned upwardly of the horizontal left-right lines HL-HR of a screen, and illuminates an overhead sign, although not shown.

Parabolic reflecting surfaces are divided into four segments, the second, third, fourth, and fifth reflecting surfaces 12, 13, 14, and 15. Further, the second, third, fourth, and fifth reflecting surfaces 12, 13, 14, and 15 are made of single or multiple segments, in accordance with light distribution characteristics, respectively.

A vehicle lighting device in the embodiment is made of constituent elements described above. Hereinafter, effects of the vehicle lighting device will be explained.

First, a light source chip 19 of a semiconductor-type light source 3 of a lamp unit 1 is intended to illuminate and emit light. A majority L1 of the light radiated from the light source chip 19 of the semiconductor-type light source 3 is then incident to a first reflecting surface 11. Further, part L5 of the light radiated from the light source chip 19 of the semiconductor-type light source 3, as direct light, is mainly directly incident to the fifth reflecting surface 15 through a second opening 10 of a reflector 2.

The light L1 incident to the first reflecting surface 11 is reflected by the first reflecting surface 11. The reflected light L2 reflected by the first reflecting surface 11 is prone to converge (gather) at or near a second focal point F12 of the first reflecting surface 11. The reflected light L2 from the first reflecting surface 11, the reflected light having not been cut off by the shade 16, is mainly incident to the second, third, and fourth reflecting surfaces 12, 13, and 14 through the second opening 10 of the reflector 2. Further, part L3 of the reflected light L2 from the first reflecting surface 11, the reflected light having been cut off by the shade 16, is reflected by a shade reflecting surface 17. Reflected light L4 from the shade reflecting surface 17 is mainly incident to the second, third, and fourth reflecting surfaces 12, 13, and 14 through the second opening 10 of the reflector 2.

The reflected light L2 from the first reflecting surface 11 and the reflected light L4 from the shade reflecting surface 17, both of which are incident to the second reflecting surface 12, are reflected by the second reflecting surface 12. The reflected light from the second reflecting surface 12 is controlled and a road surface is radiated with the controlled reflected light as a light distribution pattern SP for concentrating light shown in FIG. 7, i.e., a light distribution pattern SP for concentrating light having a horizontal cutoff line CL1 and an oblique cutoff line CL2 at an upper edge.

The reflected light L2 from the first reflecting surface 11 and the reflected light L4 from the shade reflecting surface 17, both of which are incident to the third and fourth reflecting surfaces 13 and 14, are reflected by the third and fourth reflecting surfaces 13 and 14. The rays of the reflected light from the third and fourth reflecting surfaces 13 and 14 are controlled on the third and fourth reflecting surfaces 13 and 14, and a road surface is radiated with the controlled reflected light as a light distribution pattern WP for diffusion shown in FIG. 9, i.e., as a light distribution pattern WP for diffusion having a horizontal cutoff line CL1 at an upper edge.

The light distribution pattern SP for concentrating light shown in FIG. 7 and the light distribution pattern WP for diffusion, shown in FIG. 9, are superimposed on each other, forming a light distribution pattern for passing, shown in FIG. 5, i.e., a light distribution pattern LP for passing having a horizontal cutoff line CL1 and an oblique cutoff line CL2 on an upper edge.

The direct light L5 from the light source chip 19 of the semiconductor-type light source 3, the light being directly incident to the fifth reflecting surface 15, is reflected by the fifth reflecting surface 15. The reflected light from the fifth reflecting surface 15 is controlled on the fifth reflecting surface 15, as a light distribution pattern OP for overhead sign, and the overhead sign is radiated with the controlled reflected light. As a result, as shown in FIG. 5, a light distribution pattern LP for passing formed in a state in which the light distribution pattern SP for concentrating light and the light distribution pattern WP for diffusion are superimposed on each other; and a light distribution pattern OP for overhead sign, are obtained.

If the luminous flux (luminous intensity, illumination, light quantity) of one semiconductor-type light source 3 is large, a light distribution pattern LP for passing (light distribution pattern SP for concentrating light and light distribution pattern WP for diffusion) having predetermined light distribution characteristics and a light distribution pattern OP for overhead sign, are obtained by one lamp unit 1.

The vehicle lighting device in the embodiment is made of the constituent elements and effects. Hereinafter, advantageous effects of the device will be explained.

In the vehicle lighting device (lamp unit 1) of the embodiment, as shown in FIG. 1, the second, third, and fourth reflecting surfaces 12, 13, and 14 as parabolic reflecting surfaces are longitudinally divided, and longitudinal steps 24 are formed, respectively, between the second and third reflecting surfaces 12 and 13 and between the third and fourth reflecting surfaces 13 and 14. Thus, in the vehicle lighting device (lamp unit 1) of the embodiment, if the reflected light L2 from the first reflecting surface 11 and the reflected light L4 from the shade reflecting surface 17 are incident to the longitudinal steps 24, the incident rays of light are reflected on the steps 24 in a lateral direction, i.e., in a transverse direction. As a result, the vehicle lighting device (lamp unit 1) of the embodiment can prevent vertical stray light in comparison with a vehicle lighting device in which the reflected light from the first reflecting surface and that from the shade reflecting surface are incident to lateral steps between a plurality of parabolic reflecting surfaces, which are laterally divided, so that the light is reflected at the steps in a longitudinal direction, i.e., in a vertical direction. Therefore, in the vehicle lighting device (lamp unit 1) of the embodiment, an ideal light distribution pattern, i.e., a light distribution pattern LP for passing, can be obtained by one lamp unit, making it possible to contribute to traffic safety. In particular, the vehicle lighting device (lamp unit 1) of the embodiment is effective in a case where a light distribution pattern is a light distribution pattern LP for passing because the device can prevent vertical stray light.

In the vehicle lighting device (lamp unit 1) of the embodiment, the third reflecting surface 13 of the opposite lane side (right side) is positioned in the light reflecting direction (front side) relative to the second reflecting surface 12 of the driving lane side (left side), and the second reflecting surface 12 of the opposite lane side (right side) is positioned in the light reflecting direction (front side) relative to the fourth reflecting surface 14 of the driving lane side (left side). Therefore, in the vehicle lighting device (lamp unit 1) of the embodiment, longitudinal steps 24 between the second and third reflecting surfaces 12 and 13 and between the third and fourth reflecting surfaces 13 and 14, which are longitudinally divided, are oriented to the driving lane side (left side). Therefore, in the vehicle lighting device (lamp unit 1) of the embodiment, as shown in FIG. 4, if the reflected light L2 from the first reflecting surface 11 and the reflected light L4 from the shade reflecting surface 17 are incident to the longitudinal steps 24, the incident rays of light are reflected in the lateral direction at the steps 24, in the direction of the driving lane side (left side), for example, in a range 25 shown in FIG. 5 (the range indicated by the grid pattern). This range 25 is positioned upper than the horizontal cutoff line CL1 of the light distribution pattern LP for passing and more leftward than the oblique cutoff line CL2. As a result, the vehicle lighting device (lamp unit 1) of the embodiment can prevent stray light in the lateral direction and in the direction of the opposite lane side (right side), for example, in a range 26 shown in FIG. 5 (the range indicated by the shaded pattern). This range 26 is positioned upper than the horizontal cutoff line CL1 of the light distribution pattern LP for passing and more rightward than the oblique cutoff line CL2. Therefore, the vehicle lighting device (lamp unit 1) of the embodiment can further obtain an ideal light distribution pattern LP for passing by one lamp unit, and can further contribute to traffic safety. In particular, the vehicle lighting device (lamp unit 1) of the embodiment is effective in a case where a light distribution pattern is a light distribution pattern LP for passing because the device can prevent stray light in the lateral direction and in the direction of the opposite lane side (right side).

Further, in the vehicle lighting device (lamp unit 1) of the embodiment, the second reflecting surface 12 is positioned in the middle of the parabolic reflecting surface longitudinally divided into three sections. Thus, this second reflecting surface 12 is suitable for controlling the reflected light L2 from the first reflecting surface 11 and the reflected light L4 from the shade reflecting surface 17 as a light distribution pattern SP for concentrating light shown in FIG. 7. On the other hand, in the vehicle lighting device (lamp unit 1) of the embodiment, the third and fourth reflecting surfaces 13 and 14 are positioned at the left and right of the parabolic reflecting surface longitudinally divided into three sections. Thus, the third and fourth reflecting surfaces 13 and 14 are suitable for controlling the reflected light L2 from the first reflecting surface 11 and the reflected light L4 from the shade reflecting surface 17 as a light distribution pattern WP for diffusion shown in FIG. 9. Therefore, in the vehicle lighting device (lamp unit 1) of the embodiment, the light distribution pattern SP for concentrating light, appropriately controlled on the second reflecting surface 12, and the light distribution pattern WP for diffusion appropriately controlled on the third and fourth reflecting surfaces 13 and 14, are superimposed on each other, thus allowing the vehicle lighting device to further obtain an ideal light distribution pattern LP for passing by one lamp unit 1, and to further contribute to traffic safety.

Furthermore, the vehicle lighting device (lamp unit 1) of the embodiment cuts off part L3 of the reflected light L2 from the first reflecting surface 11 by means of the shade 16, so that the light distribution pattern LP for passing having the cutoff lines CL1, CL2 can be easily controlled on the second, third, and fourth reflecting surfaces 12, 13, and 14 as the parabolic reflecting surfaces that are longitudinally divided into three sections. Moreover, in the vehicle lighting device (lamp unit 1) of the embodiment, part L3 of the reflected light L2 from the first reflecting surface 11, which has been cut off by the shade 16, is reflected by the second, third, and fourth reflecting surfaces 12, 13, and 14 of the parabolic reflecting surface longitudinally divided into three sections by means of the shade reflecting surface 17, so that the light L1 radiated from the semiconductor-type light source 3 can be efficiently utilized. Therefore, in the vehicle lighting device (lamp unit 1) of the embodiment, an ideal light distribution pattern LP for passing can be obtained by one lamp unit, making it possible to contribute to traffic safety.

Figure 11:
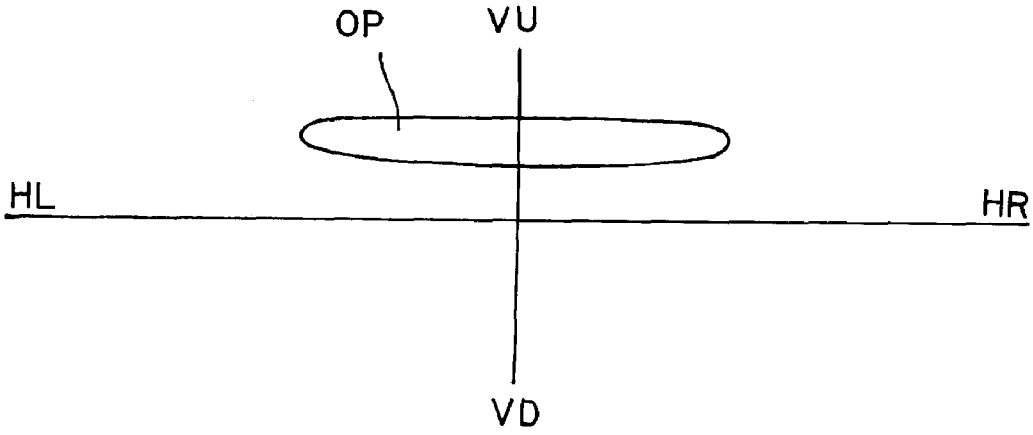
FIG. 11 is a schematic diagram for explaining a light distribution pattern for overhead sign obtained by the fifth reflecting surface.

Still furthermore, in the vehicle lighting device (lamp unit 1) of the embodiment, the fifth reflecting surface 15 as a parabolic reflecting surface for overhead sign is positioned upwardly of the second, third, and fourth reflecting surfaces 12, 13, and 14 as parabolic reflecting surfaces which are those longitudinally divided into three sections. Thus, the fifth reflecting surface 15 is suitable for controlling light L5 from the semiconductor-type light source 3 as a light distribution pattern OP for overhead sign, shown in FIG. 11. Therefore, in the vehicle lighting device (lamp unit 1) of the embodiment, ideal light distribution patterns LP and OP for passing and overhead sign can be obtained by one lamp unit 1, making it possible to contribute to traffic safety.

Yet furthermore, in the vehicle lighting device (lamp unit 1) of the embodiment, optical parts such as the first, second, third, fourth, and fifth reflecting surfaces 11, 12, 13, 14, and 15, the shade 16, and the shade reflecting surface 17 are integrally arranged at the reflector 2 that is integrally made up of the elliptical portion 5, the parabolic portion 6, the inclined portion 7, and the horizontal portion 8. Therefore, the vehicle lighting device (lamp unit 1) of the embodiment can reduce the number of parts and main-hour, and can reduce manufacturing cost concurrently. Moreover, the vehicle lighting device (lamp unit 1) of the embodiment improves precision among the optical parts such as the first, second, third, fourth, and fifth reflecting surfaces 11, 12, 13, 14, and 15, the shade 16, and the shade reflecting surface 17. Concurrently, an optical position relationship between the optical parts is determined, optical adjustment is eliminated, and a light distribution pattern can be controlled with high precision.

Hereinafter, examples other than the foregoing embodiment will be explained. In the embodiment, the light distribution pattern SP for concentrating light, of the light distribution pattern LP for passing, was formed on the second reflecting surface 12 as a parabolic reflecting surface; a light distribution pattern WI) for diffusion, of the light distribution pattern LP for passing, was formed on the third, and fourth reflecting surfaces 13 and 14 as parabolic reflecting surfaces; and a light distribution pattern OP for overhead sign was formed on the fifth reflecting surface 15 of the parabolic reflecting surface. However, in the invention, predetermined light distribution patterns, which are formed on parabolic reflecting surfaces, may be light distribution patterns other than the light distribution pattern LP for passing, the light distribution pattern SP for concentrating light, the light distribution pattern WP for diffusion, and the light distribution pattern OP for overhead sign. For example, these patterns may be: a light distribution pattern for driving; a light distribution pattern for expressway; a light distribution pattern for fog lamp; a light distribution pattern for rain; and a light distribution pattern for additional lamp or the like.

In the embodiment, the third reflecting surface 13 of the opposite lane side (right side) was positioned in the light reflecting direction (front side) relative to the second reflecting surface 12 of the driving lane side (left side), and the second reflecting surface 12 of the opposite lane side (right side) was positioned in the light reflecting direction (front side) relative to the fourth reflecting surface 14 of the driving lane side (left side). However, in the invention, the second, third, and fourth reflecting surfaces 12, 13, and 14 may not be positioned stepwise in front and in the rear.

Further, in the embodiment, the parabolic reflecting surfaces were a plurality of surfaces longitudinally divided into three sections, and the second, third, and fourth reflecting surfaces 12, 13, and 14 were formed. However, in the invention, the parabolic reflecting surfaces may be a plurality of surfaces divided into two or four or more sections.

Furthermore, in the embodiment, the shade 16 was provided, and the shade reflecting surface 17 was provided on the shade 16. However, in the invention, the shade 16 may not be provided or the shade reflecting surface 17 may not be provided on the shade 16.

Still furthermore, in the embodiment, the fifth reflecting surface 15 of the parabolic reflecting surface for overhead sign was provided upwardly of the longitudinally divided second, third, and fourth reflecting surfaces 12, 13, and 14. However, in the invention, the fifth reflecting surface 15 may not be provided upwardly of the second, third, and fourth reflecting surfaces 12, 13, and 14, and the light reflecting pattern OP for overhead sign may not be formed.

What is claimed is:

1. A vehicle lighting device employing a semiconductor-type light source as a light source and having a plurality of reflecting surfaces, said device comprising:

a first reflecting surface which is an elliptical reflecting surface to which a majority of light radiated from the semiconductor-type light source is incident;

the semiconductor-type light source being disposed at or near a first focal point of the first reflecting surface; and parabolic reflecting surfaces, having an optical axis upward of the first reflecting surface, for controlling reflected light from the first reflecting surface and reflecting the controlled reflected light as a predetermined main light distribution pattern on a road surface, wherein:

the parabolic reflecting surfaces are a plurality of longitudinally divided surfaces;

among the plurality of parabolic reflecting surfaces, the parabolic reflecting surface of an opposite lane side is positioned at a light reflecting direction relative to the parabolic reflecting surface of a driving lane side; and longitudinal steps between the plurality of parabolic reflecting surfaces which are longitudinally divided, are oriented to the driving lane side.

2. The vehicle lighting device according to claim 1, wherein:

the plurality of parabolic reflecting surfaces are made of a second reflecting surface as a middle reflecting surface and third and fourth reflecting surfaces as left and right reflecting surfaces, the reflecting surfaces being three longitudinally divided surfaces;

the second reflecting surface is a reflecting surface for controlling reflected light from the first reflecting surface and reflecting the controlled reflected light as a light distribution pattern for concentrating light on a road surface; and the third and fourth reflecting surfaces are reflecting surfaces for controlling reflected light from the first reflecting surface and reflecting the controlled reflected light as a light distribution pattern for diffusion on a road surface.

3. The vehicle lighting device according to claim 1, wherein:

a shade for cutting off part of the reflected light from the first reflecting surface is provided at or near a second focal point of the first reflecting surface;

a shade reflecting surface for reflecting part of the reflected light from the first reflecting surface on the parabolic reflecting surface, cut off by the shade, is provided at the shade; and the plurality of parabolic reflecting surfaces are reflecting surfaces, focal points of which are positioned at or near the second focal point of the first reflecting surface, and further, the reflected light from the first reflecting surface and the reflected light from the shade reflecting surface are controlled and reflected on a road surface, as a light distribution pattern for passing.

4. The vehicle lighting device according to claim 3, wherein:

a parabolic reflecting surface for overhead sign, which controls and reflects light from the semiconductor-type light source as a light distribution pattern for overhead sign, is provided upwardly of the plurality of parabolic reflecting surfaces.

5. A vehicle lighting device employing a semiconductor-type light source as a light source and having a plurality of reflecting surfaces, said device comprising:

a first reflecting surface which is an elliptical reflecting surface;

the semiconductor-type light source disposed at or near a first focal point of the first reflecting surface; and parabolic reflecting surfaces for controlling reflected light from the first reflecting surface and reflecting the controlled reflected light as a predetermined main light distribution pattern on a road surface, wherein:

the parabolic reflecting surfaces are a plurality of longitudinally divided surfaces; and a parabolic reflecting surface for overhead sign, which controls and reflects light from the semiconductor-type light source as a light distribution pattern for overhead, is provided upwardly of the plurality of parabolic reflecting surfaces.

* * * * *